United States Patent [19]

Shimohira et al.

[11] Patent Number: 4,685,622

[45] Date of Patent: Aug. 11, 1987

[54] PIECE GUN FOR SPRAYING

[75] Inventors: Shigeru Shimohira, Osaka; Yasuyuki Kimoto; Kazuo Hirota, both of Okayama, all of Japan

[73] Assignee: Meiji Kikai Seisakusyo Co., Ltd., Osaka, Japan

[21] Appl. No.: 754,123

[22] Filed: Jul. 12, 1985

[30] Foreign Application Priority Data

| | | | |
|---|---|---|---|
| Jul. 21, 1984 | [JP] | Japan | 59-110550[U] |
| Jul. 21, 1984 | [JP] | Japan | 59-110551[U] |
| Jul. 21, 1984 | [JP] | Japan | 59-110552[U] |
| Aug. 2, 1984 | [JP] | Japan | 59-163695 |
| Aug. 28, 1984 | [JP] | Japan | 59-130892[U] |

[51] Int. Cl.[4] ..... B05B 7/06

[52] U.S. Cl. ..... 239/346; 239/348; 239/365; 239/416.5; 239/424

[58] Field of Search ..... 239/418, 424, 300, 423, 239/407, 311, 340, 346–348, 369, 371, 366, 368, 416, 416.4, 417, 420, 418, 306, 326, 290, 416.5; 401/190, 109, 217; 137/625.48; 222/481

[56] References Cited

U.S. PATENT DOCUMENTS

| | | | |
|---|---|---|---|
| 398,536 | 2/1889 | Pierce | 239/417 X |
| 817,819 | 4/1906 | Walkup | 239/416 X |
| 1,504,443 | 8/1924 | Gibbons | 239/416 |
| 2,057,434 | 10/1936 | Jaden et al. | 239/318 X |
| 2,079,933 | 5/1937 | Fisher | 239/367 X |
| 2,532,851 | 12/1950 | Meyer | 239/420 X |
| 2,636,780 | 4/1953 | Barnes | 239/417 |
| 3,615,053 | 10/1971 | Pease et al. | 239/417 X |
| 3,972,630 | 8/1976 | Schenk | 401/217 |
| 3,985,457 | 10/1976 | Paroty | 401/209 |

FOREIGN PATENT DOCUMENTS

| | | | |
|---|---|---|---|
| 163187 | 10/1948 | Austria | 239/420 |
| 513862 | 2/1921 | France | 239/417 |
| 2035138 | 6/1980 | United Kingdom | 239/407 |

*Primary Examiner*—Andres Kashnikov
*Assistant Examiner*—Kevin Patrick Weldon
*Attorney, Agent, or Firm*—Birch, Stewart, Kolasch & Birch

[57] ABSTRACT

A piece gun for spraying includes a base body. A trunk portion is provided with a storage area for containing a coating liquid. The trunk portion is positioned within the base body. A head portion is connected to the trunk portion. The head portion is provided with a writing member for discharging the coating liquid. A first air passage surrounds at least the head portion of the trunk portion. A second air passage is operatively connected to a source of high pressure fluid. A switching valve includes an operational member for manual actuation and a working member operatively connected to the operational member. The working member initially operates the switching valve to connect the second air passage to the atmosphere during an early stage of operation of the operational member. The working chamber communicates the second air passage with the first air passage during a latter stage of operation.

5 Claims, 7 Drawing Figures

PIECE GUN FOR SPRAYING

BACKGROUND OF THE INVENTION

Recently, a felt pen writing tool is used for depicting, for example, an illustration wherein colored coating liquid such as aqueous or oily ink is supplied in the trunk part of the writing tool and is blown against the tip as a writing part thereof by the action of high-pressure air to be forced to atomize thereat. In conventional ones, as shown in FIG. 7, the writing tool A was inserted through the protruding part provided at the base body B, while a blow-off port C discharging high-pressure air was formed a short distance from the writing part A1 at the pointed end of the writing tool A. As a result, aside from the inconvenience of holding the tool by hand, the blown-off air jetting from aside was liable from time to time to permit the coating liquid to flow backward from the writing part A1 into the trunk part E, while on the other hand the air always incident upon the one side face of the writing part A1 was restricted to one and the same spot used. This arrangement not only helped to damage the writing part A1 but also easily incurred the unsmoothness of the efflux of the coating liquid toward the writing part A1, being accompanied by the difficulty in atomizing and spraying with a constant and smooth pace.

Further, conventional tools were so constructed that the coating liquid contained in the interior of the writing tool A was sucked out by the negative pressure occurring by the flowing of the air being blown against the writing part A1, so that the quantity of discharge of the coating liquid is sometimes insufficient to write when it is relatively hard for the coating liquid to ooze, for example, the structure of the writing tool A or the nature of the coating liquid, and so on.

Still further, in conventional tools, the relative position of the writing part A1 to the blow-off port C was fixed immovably, so that it was impossible to change by choice the state of atomization or spraying of the coating liquid, accordingly being poor in convenience for use.

Yet further, in conventional ones, a high-speed and abundant air stream was created attributable to the surge air pressure at the early stage of operation when the operational piece D was pushed down, worked on the writing part, and permitted the tool to spout out a great deal of coating liquid. When viewed like this, the use of such a kind of tool was premised to some extent of the skill to handle. In conclusion, this tool was poor in workability.

SUMMARY OF THE INVENTION

It is an object of this invention to provide a piece gun for spraying being capable of sucking out and spraying the coating liquid continuously and smoothly by letting the air blow along the whole circumferential face of the writing part.

Another object of this invention is to provide a piece gun for spraying which is convenient to handle by making it in the form of a pen.

A further object of this invention is to provide a piece gun for spraying which is capable of making the smooth spray even in the case of a writing tool which is comparatively hard for the coating liquid to ooze out on the basis of the ability to heighten the internal pressure by the use of the pressure equilibrium hole provided on the very writing tool.

Still a further object of this invention is to provide a piece gun for spraying being able to let the spraying state change to choice by altering, the relative position of the blow-off port to the writing part.

Yet a further object of the invention is to provide a piece gun for spraying being able to prevent the excessive spout of the coating liquid at the early stage of operation by making use of the switching valve releasing the surge air pressure, thereby improving the workability and the convenience of use of this invention.

BRIEF DESCRIPTION OF THE DRAWINGS

FIG. 4 is a perspective view exemplifying a metal pad of the front part thereof;

FIG. 5 is a perspective view exemplifying a working piece in a graphic form;

FIG. 6 is a perspective view showing another example of this invention; and

FIG. 7 is a side view showing the conventional piece gun for spraying in a rough sketch.

DETAILD DESCRIPTION OF THE INVENTION

Figure 1:
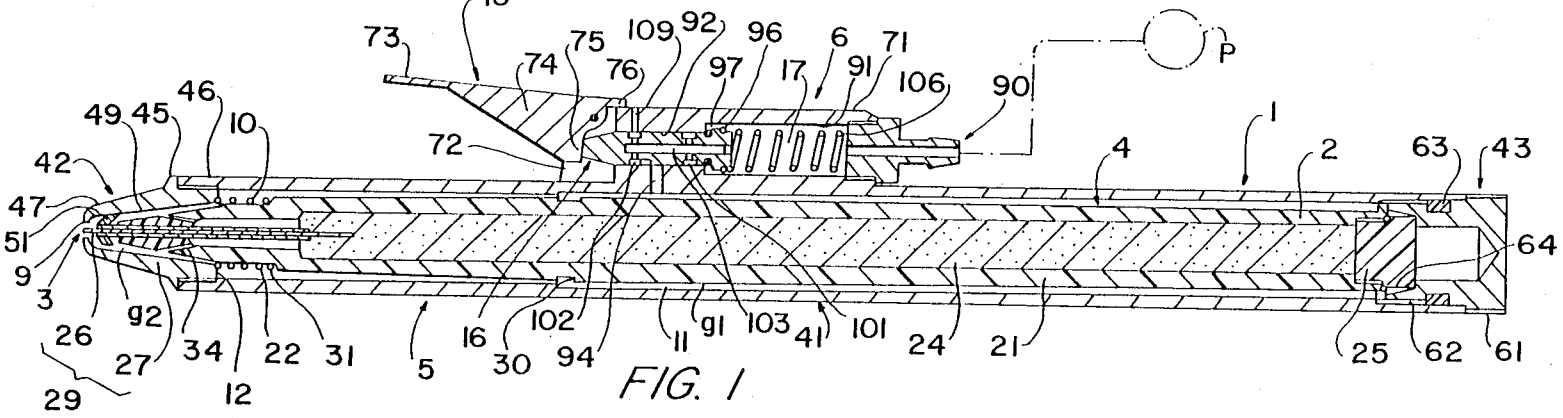
FIG. 1 is a longitudinal sectional view showing an example of this invention.
Figure 2:
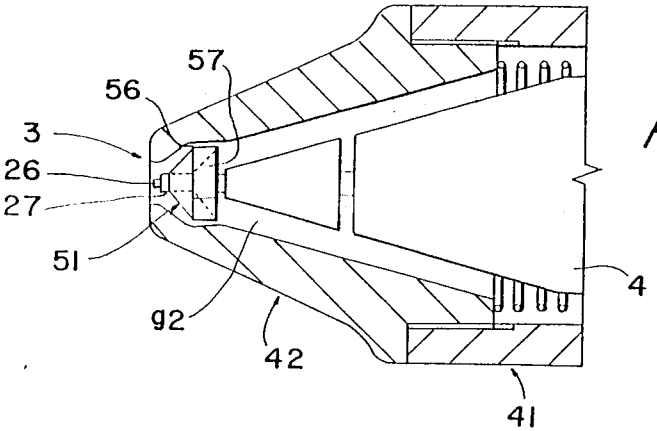
FIG. 2 is an enlarged sectional view of the front part thereof.
Figure 3:
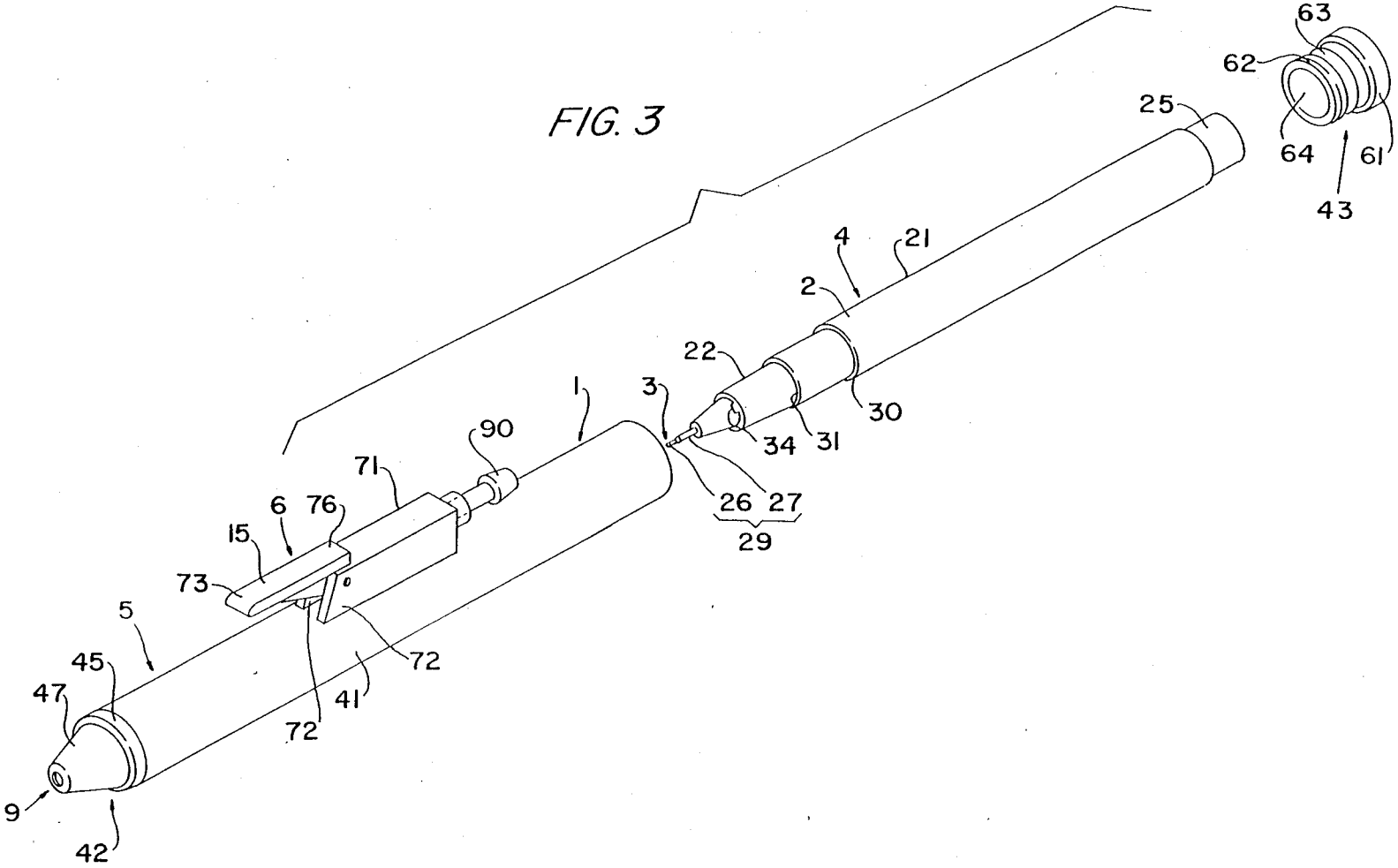
FIG. 3 is an exploded view thereof in perspective.

Description will be now directed to an example of this invention with reference to the drawings.

In the figures, a piece gun for spraying 1 provided at its base body 5 with a pen-like writing tool 4 is to be attached with a first air passage 11 surrounding the tip part of the writing tool 4 and a second air passage 17 communicating with the first air passage 11 through the interposition of a switching valve 6; wherein the first air passage 11 is open at a blow-off port 9.

The writing tool 4 mounts a writing part 3 protuberantly on the front end of a trunk part 2. The trunk part 2 in this example forms a tapered cone part 22 at the front end of a straight tube part 21 which is opened at its rear end, and is filled with an impregnant 24 such as felt impregnated with the coating liquid. Of course, the rear end of the straight tube 21 is in a state of being sealed by means of a tap piece 25. On the other hand, fixed fast onto the cone part 22 is a front fitting 29 consisting of a metal tube 27 and a tip 26 having continuous holes and being securedly inserted into the above metal tube 27. The head part of the above-mentioned tip 26 projects out of the metal tube 27, while the front end part of the metal tube 27 protrudes from the cone part 22 forward. In this way, the writing part 3 is formed by the tip 26 and metal tube 27 constituting the front fitting projecting from the cone part 22. The tip 26 comes in contact with the impregnant 24 to make the coating liquid ooze out to the writing part 3. With regard to the writing part 3, it is possible to use one having the tip 26 while deleting the metal tube 27 or one being formed only with metal tube 27. To sum up, the writing part 3 is a small diametrical part projecting from the body part 2 and being smaller in diameter than that trunk part 2.

There is provided at the above mentioned straight tube 21 a difference in step 30 for fitting a cap suited for the writing tool 4, while there is also provided at the boundary between the straight tube 21 and the cone part 22 a forward facing step part 31. Further the cone part 22 is provided near the middle position with a pressure equilibrium hole 34 for communicating inside of the trunk part 2 with the outside thereof by means of piercing through both sides.

The base body 5 in this example is a pen-like container housing within itself the writing tool 4. The base body 5 includes a shell body 41 covering the above-mentioned straight tube 21 through the interposition of an air gap g1, a nozzle fitting 42 covering the front end of the shell body 41, and a cap shaped biasing means 43 covering the rear end thereof.

The nozzle fitting 42 is provided at the circumferential surface of the part extending rearwards from a flange part 45 which is level with the shell body 41 with a screw part 46 being screwed fittingly into the shell body 41, and further the nozzle fitting 42 is provided at its front part with a tapered nose 47.

Still further, the nozzle fitting 42 is provided with an inner hole 49 into which the cone part 22 of the above-mentioned writing tool 4 is positioned while leaving room for an air gap g2. The front of the inner hole 49 forms the above-mentioned blowing-off port 9 of a small hole, while a parallel part of narrow breadth is provided inside near the blowing-off port 9. Attached to this paralled part is a support pad 51. This supporting pad 51, shown in FIG. 4, has an outer-diametrical dimension fit right in with the above-mentioned parallel part, and has an inner hole 55 for floatingly inserting the above-mentioned metal tube 27. The inner hole 55 is bored at the center of a conformed body 54 being made to incline against the front and rear faces of the supporting pad 51 in the form of a cone of the angle of about 45°. On the other hand, the outer-circumferential edge of the above-mentioned front face is provided with a difference in step 56, while there are formed three (3) cutaway parts for air-conducting 57 which are created by cutting off the outer-circumferential part of the conformed body 54 flatly with the inner brim of the difference in step 56 as the starting point, and then the pad 51 is attached to the above-mentiond parallel part by pressing-in.

The above-mentioned biasing means 43 is provided at a flange 61 of the same diameter as the shell body 41 with a screw part 62 screwing into the shell body 41, and the screw part 62 is provided between itself and the shell body 41 with a seal 63 for sealing the interval of the both. Further, the screw part 62 is provided with a stepped hole 64 for receiving the rear end of the above-mentioned writing tool 4.

The writing tool 4 is inserted into the interior of the base body 5 through the interposition of a spring means 10 consisting of, for example, a coil spring between the step part 31 of the straight tube 21 and the end face of the screw part 46 of the nozzle fitting 42, while the rear end of the writing tool 4 is supported by the stepped hole 64 of the biasing means 43, being received in the interior of the base body 5. The writing tool 4 in this example is further attached to the base body 5 through the reception as mentioned above. The metal tube 27 of the writing tool 4 is supported by the inner hole 55 of the supporting pad 51, as mentioned above, and the rear end thereof is held coaxially with the shell body 41 by being fitted in the stepped hole 64 of the biasing means 43. Accordingly, air gaps g1 and g2 are formed between the writing tool 4, the shell body 41, and the nozzle fitting 42. In this example, the two air gaps g1 and g2 are formed with the first air passage 11 surrounding the writing tool 4 inclusive of the front part along its whole length. Therefore, the above-mentioned pressure equilibrium hole 34 communicates with the first air passage 11, whereby the internal pressure of the writing tool 4 is pressurized to keep balance with the air pressure of the first air passage 11.

The above-mentioned spring means 10 biases the writing tool 4 in the longitudinal direction rearwardly. On the other hand, the above-mentioned end face of the screw part 46 of the nozzle fitting 42 forms a supporting part 12 receiving one end of the writing tool 4 through the spring means 10, while the above-mentioned biasing means 43 shifts the writing tool 4 in the longitudinal direction forewards against the above-mentioned spring means 10 by the biasing means 43 being screwed-in, and is able to make the writing tool 4 shift backwards by unscrewing.

In this way, the writing tool 4 shifts in the longitudinal direction through the screwing backward-and-foreward of the pushing-onward means 43, positioning the writing part 3 in the interior of the blowing-off port 9 making it project from the blowing-off port 9, as occasion demands, whereby the relative position between the blowing-off port 9 and the writing part 3 can be varied.

The above-mentioned switching valve 6 in this example, which is provided with an operational piece 15 for the finger-operation and a working piece 16 starting to work owing to the operation of the above operational piece 15, is mounted on the shell body 41.

The switching valve 6 is provided at the front end of a square pillar-shaped base sleeve 71 with bearing pieces 72, 72 each jutting out to both sides. Between two bearing pieces 72, 72 is pivoted the operational piece 15. This operational piece 15 in this example takes the form of a lever. Below the top piece 73 is provided a pivoting piece 74 which is inserted between the above-mentioned bearing pieces 72, 72 and is pivoted as mentioned above. The lower part of the operational piece 15 is made bulgy to become a push piece 75 for pushing the working piece 16. By the way, the above-mentioned top piece 73 is provided with a projecting piece 76 being hung on the upper face of the above-mentioned base sleeve 71 in a state where the top piece 73 is parallel with the base body 5.

The above-mentioned base sleeve 71 is provided with a stepped hole consisting of a large diametrical part 91 whereinto an air nipple 90 fits at the rear end of the base sleeve 71 and a small diametrical part whereinto the working piece 16 is inserted, and the above-mentioned small diametrical part 92 is provided at its middle part with a side hole 94 extending up to the interior of the shell body 41.

The above-mentioned working piece 16 is a pin-like body which has a tapered part 95 at its front end part and is provided around its rear end with a flange 96, as illustrated in detail in FIG. 5. Adjacent to the above-mentioned flange 96, there is formed a circumferential groove 99 wherein a seal 97 such as an O ring is positioned. In the forward direction of the above groove 99, two other circumferential grooves 101 and 102 are further provided spacing the respective intervals. Further, in the center of the working piece 16, there is provided a guide hole 103 which extends ahead of the circumferential groove 102 and is sealed at the rear end with a step, while there are provided side holes 104 and 105 communicating with the guide hole 103 at the bottom faces of the circumferential grooves 101 and 102, respectively.

In the working piece 16, the seal 97 has the function to close a valve seat which is created by the difference in step between the large diametrical part 91 and the small diametrical part 92 on the basis of compressing the flange 96 by the spring 106 one end of which is supported by the above-mentioned air nipple 90. In such a condition, while the above-mentioned circumferential groove 102 shifts from the position of the side hole 94, it can come into alignment with an exhaust hole 109 provided at the base sleeve 71 and communicating with the open air. On the other hand, the head part of the working piece 16 projects out of the base sleeve 71, and impinges upon the push piece 75 of the above-mentioned operational piece 15.

When the top piece 73 of the above-mentioned operational piece 15 is pushed down by finger-operation, then the push piece 75 forces the working piece 16 rearwardly and lets the circumferential groove 101 protrude into the large diametrical part 91. Accordingly, the air in the large diametrical part 91 passes from the circumferential groove 101 and the side hole 104 and further from the circumferential groove 102 and the side hole 105 through the guide hole 103 to the above-mentioned side hole 94, whereby there is formed the second air passage 17 communicating with the first air passage 11.

In the early stage of operation of the operational piece 15 where the above-mentioned circumferential groove 101 projects slightly into the large diametrical part 91, the circumferential groove 102 communicates with both the exhaust hole 109 and the side hole 94 at the same time, wherefore the surge air pressure as an impulsive pressure being liable to be produced in the early stage of operation is exhausted from the exhaust hole 109 to the open air. Further, in the latter stage of operation where the operational piece 15 pushed down, the circumferential groove 102 is off the exhaust hole 109, and the second air passage 17 is conducted to the first air passage 11 only.

The above-mentioned air nipple 90 is connected to a high-pressure air source P such as, for example, an air compressor having the ability to produce high-pressure air, or a high-pressure tank storing high-pressure air. On the other hand, the second air passage 17 is opened by pushing-down the operational piece 15 by an individual's finger when the high-pressure air being contained therein is conducted into the first air passage 11. By the way, the surge air pressure in the early stage of operation can be exhausted through the exhaust hole 109 to the open air, as mentioned above, while the high-pressure-air in the first air passage 11 flows away along the inner hole 49 of the nozzle fitting 42 and, after blowing aslant the writing part 3, flows out of the blowing-off port 9.

The high-pressure air flowing through the above-mentioned pressure equilibrium hole 34 of the writing tool 4 into the interior thereof applies pressure to the impregnant 24, that is, the coating liquid contained therein, and consequently allows the coating liquid to smoothly flow out, while being used, by giving help to the suction force attributed to the negative pressure acting on the writing part 3 on the bases of the high-pressure air stream flowing along the writing part 3.

On the other hand, it is possible to adjust the relative position between the writing part 3 and the blowing-off port 9 by screwing back-and-forth the above-mentioned pushing-onward means 13, and further thereby to regulate the discharge amount of the coating liquid, the spraying state, and so on.

THE EFFECT OF THE INVENTION

As described above, the piece gun for spraying according to this invention includes a first air passage formed surrounding the head part of the writing tool at the base body to which the writing tool is attached. The piece gun according to the invention has the ability both to blow the high-pressure air from the whole circumference onto the writing part of the writing tool and to suck out the coating liquid smoothly. The result being an efficiency in operation for improving the spraying condition.

Since the base body of the piece gun is formed in the shape of a pen, it has a good accomodation to the hand and in addition it is able to enhance the convenience for use and operation.

On the other hand, with the arrangement of the pressure equilibrium hole being made to face the first air passage, the internal pressure of the writing tool is heightened, the coating liquid can be efficiently discharged, and smooth spraying becomes possible.

Further, by varying the relative position between the writing part and the blowing-off port, it is possible to change the discharge amount of the coating liquid or the state of the liquid being atomized to one's preference.

Still further, by making use of the switching valve which lets go the surge air pressure to the open air, it is possible to prevent the excess of discharge of the coating liquid being apt to be produced at the early stage of operation, and also to make the spraying condition constant.

Incidentally, as shown in the rough sketch of FIG. 6, it does not matter if the base body 5 of the piece gun for spraying according to this invention is formed with the head part only of the writing tool 4 inserted thereinto so as to be sealed in the base body as a holder, if there is only able to be formed an air passage surrounding the head part of the writing tool 4; otherwise it is also permissible to use, for example something of a push-button type in the capacity of the operational piece 15.

However, not being limited to the above-mentioned, it goes without saying that the piece gun for spraying according to our invention can be modified into various kinds of embodiments.

What is claimed is:

1. A piece gun for spraying comprising:

a base body;

a trunk part including a storage area for containing a coating liquid, said trunk part being positioned within said base body;

a head portion connected to said trunk part and provided with a writing member for discharging said coating liquid;

a first air passage surrounding at least said head portion of said trunk part;

a second air passage which may be operatively connected to a source of high pressure fluid;

a switching valve including an operational member for manual actuation and a working member operatively connected to said operational member wherein the working member initially operates the switching valve to connect the second air passage to the atmosphere during an early stage of operation of said operational member and said working member communicates the second air passage with the first air passage during a latter stage of operation.

2. A piece gun for spraying as set forth in claim 1, which is characterized in that said trunk part is provided with a pressure equilibrium hole for communicating the inside of said trunk part to said first air passage.

3. A piece gun for spraying as set forth in claim 1, which is characterized in that said base body is provided with an adjustable means which can shift the trunk part in the longitudinal direction of said base body relative to a blowing-off port formed at the end of said first air passage.

4. A piece gun for spraying as set forth in claim 1, wherein said base body is a pen-like container.

5. A piece gun for spraying as set forth in claim 1, wherein said base body is provided with a supporting pad positioned within said base body for holding said head portion and forming an air passage between the supporting pad and said pen-like base body for flowing the air through the first air passage;

said supporting pad being held positively at the inner surface of said base body.

* * * * *